United States Patent [19]

Smith

[11] 3,977,634

[45] Aug. 31, 1976

[54] COMPUTER FOR MOTION SENSING DEVICE SETUP

[75] Inventor: Richard E. Smith, Ontario, Calif.

[73] Assignee: Safetran Systems Corporation, Louisville, Ky.

[22] Filed: June 9, 1975

[21] Appl. No.: 584,729

[52] U.S. Cl. ..... 246/128; 246/125

[51] Int. Cl.[2] ..... B61L 29/28

[58] Field of Search ..... 246/125, 128, 130

[56] References Cited

UNITED STATES PATENTS

| | | | |
|---|---|---|---|
| 3,603,786 | 9/1971 | Peel | 246/128 |
| 3,614,418 | 10/1971 | Pell | 246/128 |
| 3,777,139 | 12/1973 | Peel | 246/125 |

*Primary Examiner*—Trygve M. Blix
*Assistant Examiner*—Reinhard J. Eisenzopf
*Attorney, Agent, or Firm*—Kinzer, Plyer, Dirn & McEachran

[57] ABSTRACT

A system for calibrating a receiver in a railroad grade crossing protection system having a transmitter and receiver connected to the rails and a defined approach track section, utilizes the receiver detected motion voltage to determine low ballast resistance. A signal representative of the ballast condition is then utilized in conjunction with the signal representative of train motion to calibrate the receiver for the particular ballast condition.

8 Claims, 3 Drawing Figures

COMPUTER FOR MOTION SENSING DEVICE SETUP

SUMMARY OF THE INVENTION

The present invention relates to the field of motion sensing devices for use on railroad crossings and has particular relation to a means for setting up or calibrating the receiver in a motion sensor system.

A primary purpose of the invention is a system of the type described including means for calibrating receiver gain to take into account the prevailing ballast condition.

Another purpose is a method of the type described which utilizes the separation of the impedance and reactive components of the receiver voltage as an indication of ballast condition.

Another purpose is a simply constructed reliably operable system and method for calibrating a receiver in a motion sensor to take into account prevailing ballast conditions.

Another purpose is a motion sensor including circuit means for measuring ballast condition as a consequence of the separation between the impedance and reactive voltages representative of train motion.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The present invention relates to a motion sensor system of the type generally shown in U.S. Pat. No. 3,777,139. As a part of the receiver in the motion sensor system, certain voltages are developed in the manner shown in U.S. Pat. No. 3,614,418.

Figure 1:
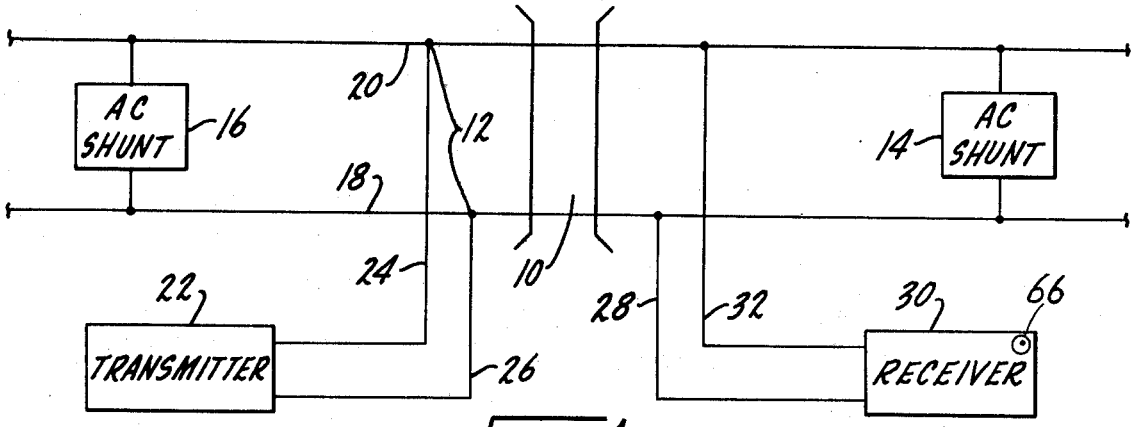
FIG. 1 is a diagrammatic illustration of a motion sensing system of the type described.

Looking particularly at FIG. 1, a railroad crossing is indicated at 10 and the system described herein is designed to activate crossing protection equipment such as gates and/or signals, depending upon location of the crossing. The system will activate the crossing protection equipment whenever a train is within the section of track being monitored and is approaching the crossing at a speed greater than a predetermined minimum speed, or when there is a malfunction in the system.

As is known in the art, the approach length of track becomes an integral part of the sensor system and this length is established as a function of maximum train speed, minimum warning time and the system's response time so that the crossing gates and/or signals are operated in sufficient time to provide adequate protection and warning.

In FIG. 1, the transmitter feed point 12 is adjacent the crossing 10 and there are approach distances on each side of the feed point. The right-hand approach is determined by the position of an AC shunt 14 and the left-hand approach is determined by the position of an AC shunt 16. The approach distances may be the same or they may be different, depending upon the particular utilization of the track in question. The shunts 14 and 16 are connected between rails 18 and 20 and, in like manner, the feed point 12 is connected to both rails 18 and 20.

The shunts 14 and 16 may be a hard wire connection, a wide band AC device, such as a capacitor, or a narrow band AC device such as a sharply tuned resonant circuit. The particular type of shunt will depend upon what other signals are being transmitted through the rails.

The operation of the motion sensor system is based upon a change in impedance of the track as an approaching train shunts the rails 18 and 20. Such a shunt shortens the effective length of the track section being measured and thus reduces impedance. The motion sensor system will respond to the approaching motion of a train to activate the crossing equipment if the train speed is above a predetermined minimum. The system will be de-activated if the train stops while it is in the approach section or its speed is reduced below the minimum required for a crossing operation. At such time as the train resumes forward motion, the protection equipment will again be operated.

The transmitter 22 will provide a signal at a selected frequency, for example in the range of 26–645 Hz, which is a constant current signal. The transmitter 22 is connected by lines 24 and 26 to rails 18 and 20, respectively, on one side of the crossing.

Both transmitter 22 and receiver 30 are described in greater detail in the above-mentioned patents as well as in a co-pending application, U.S. Pat. No. 3,944,173, assigned to the assignee of the present application and entitled "Railroad Crossing Motion Sensing System".

The receiver will provide, within its overall circuitry, several voltages which relate to and are representative of train motion within the approach track section. Specifically, a distance voltage $E_D$ which will remain constant, since a constant current signal is applied to the rails, as long as there is no change in impedance of the approach section. Normally, a decrease in $E_D$ signifies motion within the approach track section. A voltage $E_{DX}$ is representative of the reactance component of the detected voltage and a voltage $E_{DZ}$ is representative of the impedance of the detected voltage. All of these voltages are derived in the manner described in U.S. Pat. No. 3,614,418 and are utilized in the present invention which is specifically directed to a system and method for calibrating the receiver to take into account prevailing ballast conditions.

Figure 3:
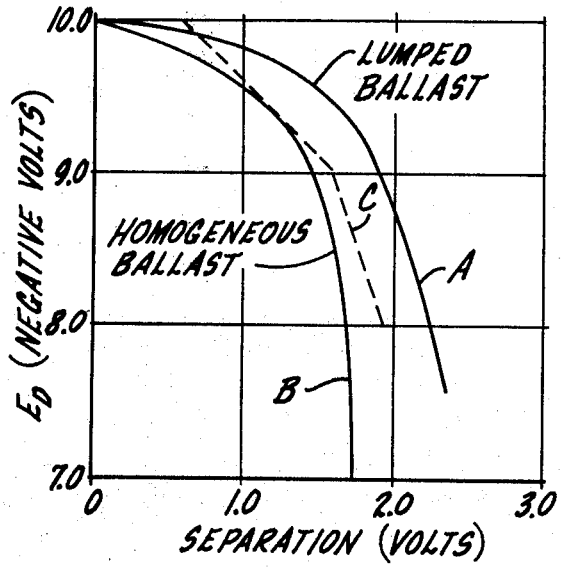
FIG. 3 is a curve comparing the separation of the impedance and reactive components of receiver voltage with the receiver voltage.

It is well known in the art that ballast resistance varies substantially with the condition of the ballast, i.e. the amount of moisture present, as well as other factors. Ballast resistance may be homogeneous, i.e. evenly distributed along the approach section, or it may be lumped. However, the detected voltage $E_D$, which is nominally set at the factory for 10 volts with no approach train motion, must be calibrated to take into account the prevailing ballast conditions in order to provide an appropriate indication of approaching train motion. Looking specifically at FIG. 3, there are several curves comparing $E_D$ on one axis and the separation between $E_{DX}$ and $E_{DZ}$ on another axis. The separation of $E_{DX}$ and $E_{DZ}$ has been found to give a direct indication of the prevailing ballast condition. For example, the presence of low ballast resistance is indicative of a large separation between these two derived voltages. As indicated above, the separation itself can vary depending upon whether the ballast resistance is homogenous or lumped. Thus, curve A in FIG. 3 is representative of the separation between $E_{DX}$ and $E_{DZ}$ for a lumped ballast resistance, whereas, curve B represents a homogeneous ballast resistance. In order to properly calibrate the receiver, a mathematically calculated curve. curve C, has been placed generally intermediate curves A and B, and the circuit to be described hereinafter has been developed to follow curve C for a particular frequency.

Figure 2:
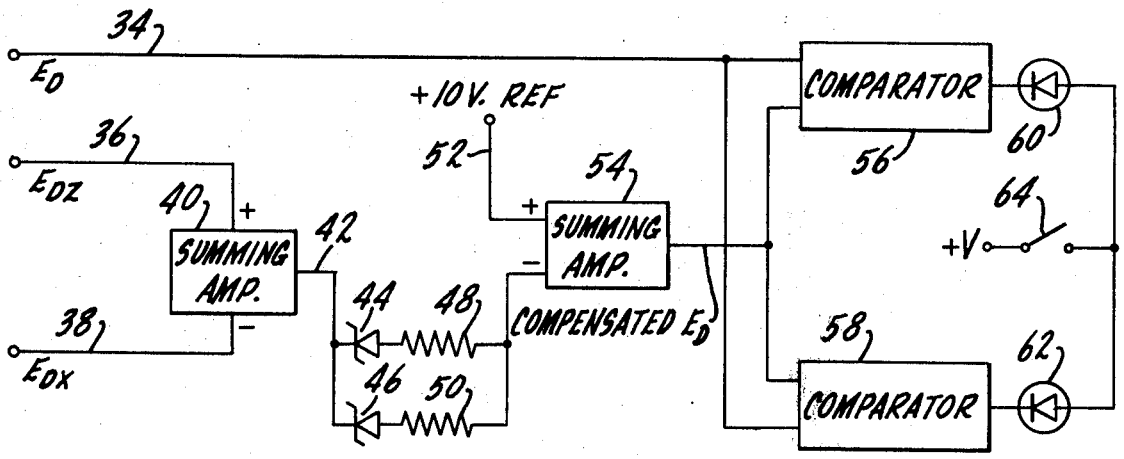
FIG. 2 is a schematic illustration of a portion of the receiver.

Looking at FIG. 2, which shows a portion of the receiver, $E_D$ is provided on line 34; $E_{DZ}$ on line 36; and $E_{DX}$ on line 38. $E_{DZ}$ and $E_{DX}$ are combined in a summing amplifier 40, the output of which, one line 42, will be the separation between these two voltages which, as illustrated in FIG. 3, will be indicative and representative of the prevailing ballast conditions. However, since the relationship between the separation of these two voltages and $E_D$ is not linear, and may vary due to the prevailing ballast conditions, i.e. either homogeneous or lumped ballast resistance, it is necessary to follow curve C which is generally intermediate the extremes in ballast condition and which is susceptible of being simply derived from relatively inexpensive electric circuits.

Thus, a pair of zener diodes 44 and 46 are connected in parallel and each of the zener diodes have resistors 48 and 50 in series. There may be additional such series combinations in parallel, depending upon how many sections are necessary to construct curve C. For example, in FIG. 3 there are two sections of the curve. There may be additional sections, depending upon the particular frequency being used in the transmitter and receiver.

The parallel combination of the zener diodes and resistors is connected, along with a 10 volt reference signal on line 52, to a second summing amplifier 54. The output of summing amplifier 54, which is a compensated $E_D$, is connected to comparators 56 and 58 which also receive the voltage $E_D$. The output of high comparator 56 is connected to a light emitting diode 60, whereas, the output of low comparator 58 is connected to a light emitting diode 62. LEDs 62 and 60 are connected to a switch 64 which is connected to a source of positive voltage. The switch is the operating switch which is used to set the calibration circuit in operation and at the same time disable other circuitry within the receiver which could be affected by the calibration.

As indicated above, $E_D$ will normally be set for a nominal value of 10 volts at the factory. The setting will of course take into account the length of the approach track section, as this will vary from installation to installation. Since $E_D$ can be substantially affected by the condition of the ballast, it is the purpose of the present calibration system to adjust $E_D$ so that it reflects ballast condition in its output value, which value is used in various additional circuitry in the receiver such as described in the above-mentioned copending application.

Assuming that there is in fact a separation between $E_{DZ}$ and $E_{DX}$, indicative of a lowering or deteriorating ballast condition, then it is desirable to adjust $E_D$ to take that into account. The adjustment on the receiver is diagrammatically illustrated by a calibration dial 66 in FIG. 1. Assuming a separation between $E_{DZ}$ and $E_{DX}$ at the output of summing amplifier 40 of 1 volt, zener diode 44 will conduct, placing resistance 48 in parallel with the output of summing amplifier 40 on line 42. This voltage will be applied to summing amplifier 54 along with a carefully regulated 10 volt reference voltage on line 52. The output from summing amplifier 54 will be a voltage of approximately 11.0 volts. With a separation voltage of approximately 1.0 volt, $E_D$ will have a value of approximately 9.5 volts (FIG. 3). Since actual $E_D$ is less than compensated $E_D$, the low comparator LED 62 will be activated. The high comparator LED 60 will be activated when actual $E_D$ is above compensated $E_D$ and the low comparator LED 62 will be activated when the reverse condition prevails. However, there is a degree of overlap between the values at which these comparator LEDs will be lit. Thus, when both LEDs are activated, it is an indication that the receiver is in calibration and that $E_D$ has been set to take into account the particular ballast condition.

In the present instance, received gain is adjusted which effects both compensated $E_D$ and actual $E_D$. As the degree of overlap between the comparators is 0.5 volt in range, receiver gain will be adjusted until both LEDs are lit which indicates that actual $E_D$ and compensated $E_D$ are separated by no more than 0.5 volt.

The invention is particularly applicable in quickly and reliably calibrating or setting up a motion sensor device of the type described generally in the above patents and more specifically in the above-mentioned copending application. The setup takes into account ballast conditions as determined by the separation of the impedance and reactive components of the voltage representative of approaching motion, which voltage will have a constant value with no motion present. The comparison between the separation of the impedance and reactive components of the detected voltage and $E_D$ is non-linear. In order to provide a more linear voltage, and one which represents the ballast condition for a particular frequency, a curve has been calculated and plotted and voltage regulating devices in the form of parallel series combinations of zener diodes and resistors are used to accurately represent the particular place on the curve where the separation occurs.

Whereas the preferred form of the invention has been shown and described herein, it should be realized that there may be many modifications, substitutions and alterations thereto.

The embodiments of the invention in which an exclusive property or privilege is claimed are defined as follows:

1. A method of calibrating a receiver in a railroad grade crossing protection system having a transmitter and receiver connected to the rails and a defined approach track section including the steps of:

a. providing an electrical signal indicative of ballast condition, b. comparing said ballast signal with $E_D$, c. varying receiver gain until the variation between $E_D$ and said ballast signal is within predetermined limits.

2. The method of claim 1 further characterized in that said ballast condition signal is determined by measuring the separation between $E_{DX}$ and $E_{DZ}$.

3. The method of claim 2 further characterized in that the actual separation of $E_{DX}$ and $E_{DZ}$ is compared with a programmed relationship between such separation and $E_D$ to arrive at said electrical signal indicative of ballast condition.

4. In a receiver for use in a railroad grade crossing protection system having a transmitter and receiver connected to the rails and a defined approach track section, circuit means in said receiver for deriving $E_D$, $E_{DX}$ and $E_{DZ}$, circuit means for determining the separation of $E_{DX}$ and $E_{DZ}$ and for providing a signal indicative of ballast condition, circuit means for comparing said ballast signal and $E_D$, and means for varying receiver gain until the comparison between $E_D$ and the ballast signal is within predetermined limits.

5. The receiver of claim 4 further characterized in that the circuit means for determining the separation of $E_{DX}$ and $E_{DZ}$ and for providing a signal indicative of ballast condition includes means for summing $E_{DX}$ and $E_{DZ}$ and a plurality of parallel connected zener diodes and resistor series combinations connected to the output of said summing circuit.

6. The receiver of claim 5 further characterized by and including a source of a reference voltage connected to the output of said parallel combination, and a second summing circuit connected to said reference voltage and the output of said parallel combination.

7. The receiver of claim 6 further characterized in that said circuit means for comparing includes a pair of comparators, each having inputs of $E_D$ and the output of said second summing circuit, and indicating means connected to the output of each comparator, with the indicating means having an overlap in their indicating ranges.

8. The receiver of claim 7 further characterized in that said indicating means includes light emitting diodes.

* * * * *